US006147854A

United States Patent [19]

Kirschner

[11] Patent Number: 6,147,854

[45] Date of Patent: Nov. 14, 2000

[54] ELECTRICITY SHUNTING AND REROUTING DEVICE AND METHOD

[76] Inventor: Garry William Kirschner, 109 Killarney Place, London, Ontario, Canada, N5X 2B5

[21] Appl. No.: 09/239,774

[22] Filed: Jan. 29, 1999

[51] Int. Cl.[7] ..... H02H 1/00

[52] U.S. Cl. ..... 361/212; 361/220

[58] Field of Search ..... 361/212, 220, 361/223–224

[56] References Cited

U.S. PATENT DOCUMENTS 3,541,389 11/1970 Van Name et al. .
3,857,397 12/1974 Brosseau ..... 607/149
5,440,444 8/1995 Adams .
5,548,469 8/1996 Adams .
5,704,066 1/1998 Yamamoto .
5,715,536 2/1998 Banks ..... 2/69

*Primary Examiner*—Michael J. Sherry
*Attorney, Agent, or Firm*—Fleshner & Kim, LLP

[57] ABSTRACT

An electricity shunting and rerouting device designed as forming an integral part of a garment comprising conductive metal bracelets (and/or waistbands and/or anklets) joined by an insulated conductor, the size and type of which may vary depending on the application, thereby allowing the potentially harmful electrical current to flow through the insulated conductor/wire and rerouting the current away from the worker's inner parts, such as vital organs and muscles, thereby minimizing the health risk of electrocution.

33 Claims, 4 Drawing Sheets

ELECTRICITY SHUNTING AND REROUTING DEVICE AND METHOD

FIELD OF THE INVENTION

This invention relates to an electrically conductive device and more particularly to an electrically conductive device suitable for use by workers working in the vicinity of live electrical equipment and designed to be adapted as part of a garment.

BACKGROUND OF THE INVENTION

Typically, electrical line workers, maintenance workers and construction workers working in the vicinity of live electrical equipment including transmission lines, substations, generating stations, and general construction sites where contact with live electrical equipment is common have been susceptible to electrocution as a result of malfunction or mistake which may lead to severe discomfort or even death in some circumstances.

Various articles have been used in order to avoid the potentially undesirable effects of electrical current running through one's body. Some of the more traditional articles for eliminating electrical current have included grounded wrist straps, grounded smocks, grounded footwear and gloves constructed of electrically conductive material.

Generally, the proposed articles have been for use in the field of static electricity control for use in the manufacturing of electronic components where there is a need for the workers involved to be as free as possible of static electricity due to the extremely sensitive nature of electronic components.

One of the difficulties attending the application of the above mentioned articles is their connection to ground that causes the articles insufficient for reducing the health risk to the user in the presence of harmful electric current.

SUMMARY OF THE INVENTION

The present invention provides for an electricity shunting device adapted to be used as part of a garment designed to overcome the above shortcomings.

An object of the present invention is to provide a shunting/protecting device which is simple and easy to use.

Another object of the present invention is to construct an electricity shunting garment which is manufactured in a simple manner and therefore can be constructed inexpensively and ultimately sold at a relatively low price to the consumer thereby making it widely available.

An additional object of the present invention is to provide an electricity shunting and rerouting device comprising a) a flexible conductor; b) conductive bracelets; and c) attachment means for connecting said flexible conductor to said conductive bracelets.

An additional object of the present invention is to provide an electricity shunting and rerouting garment comprising a) a flexible conductor; b) conductive bracelets; c) attachment means for connecting said flexible conductor to said conductive bracelets; and d) means for securing said combination of flexible conductor and conductive bracelets to the garment, said garment having a pair of sleeve sections connected to a body section, said sleeve sections terminating in hems at cuff sections, and a collar section; whereby the flexible conductor is adapted to run uninterrupted along the sleeve and collar sections leading to the conductive bracelets forming part of the cuff sections.

An additional object of the present invention is to provide a method for shunting and rerouting electrical energy away from a worker's inner parts comprising the steps of a) connecting a flexible conductor to conductive bracelets; and b) attaching said flexible conductor and conductive bracelets combination to a garment.

Further objects and advantages of the present invention will be apparent from the following description, wherein preferred embodiments of the invention are clearly shown.

This invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

The present invention will be further understood from the following description with reference to the drawings in which.

DETAILED DESCRIPTION OF THE INVENTION

Figure 1:
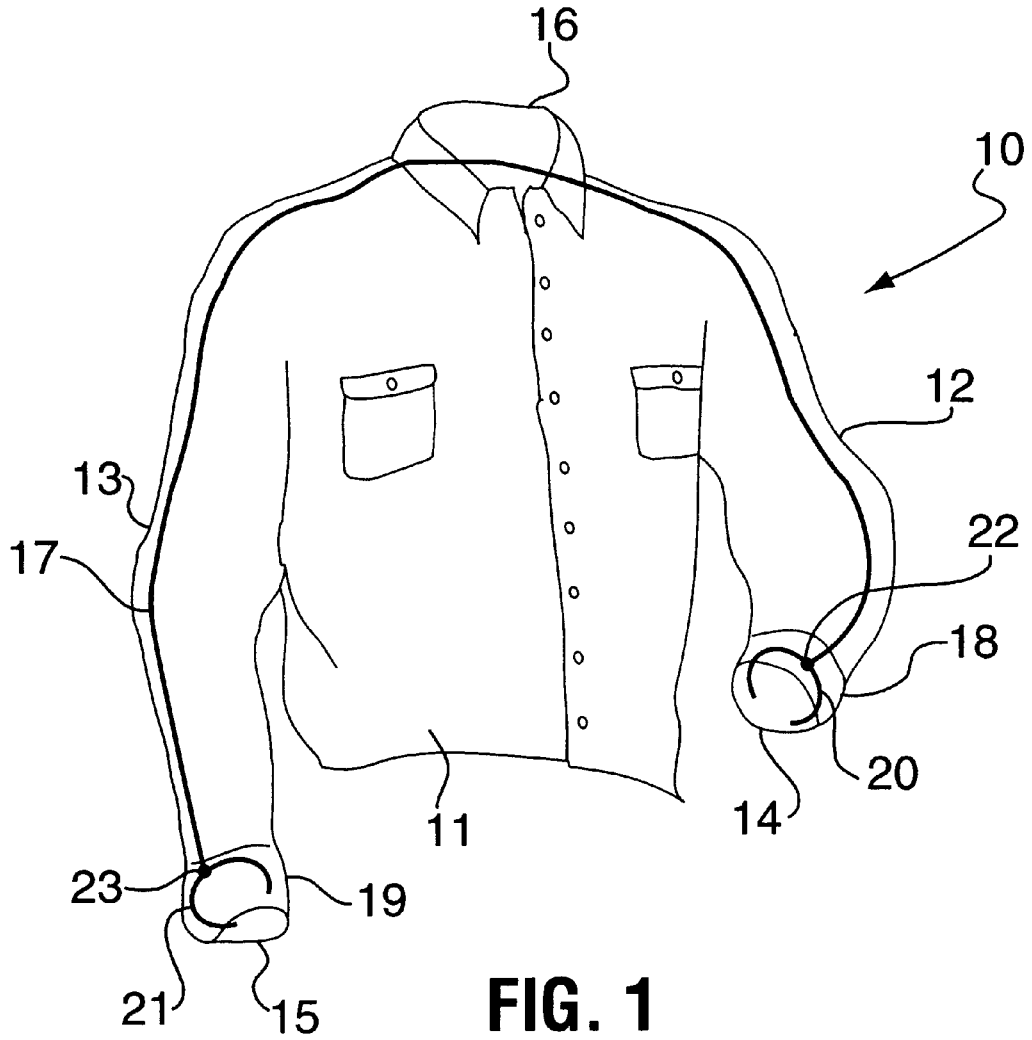
FIG. 1 is a front view of a garment embodying principles of the present invention.

The garment 10 illustrated in FIG. 1 is in the form of a work shirt having a front that can be opened and closed. This particular style of garment is employed solely for purposes of illustration, since, as will readily be understood from the following detailed description, the shape and style of the garment can vary without departing from the principles of the present invention.

The garment 10 includes a body section 11, sleeve sections 12, 13, connected to said body section 11, terminating in hems 14 and 15 at cuff sections 18 and 19 respectively and collar section 16.

An insulated flexible wire or conductor 17, which can be made of copper for instance, and of different types of element and sizes according to voltage range one may face in a working environment, runs uninterrupted within the material raceway of sleeve sections 12, 13 and collar 16. Attached to flexible wire 17 at the open ends located in cuff sections 18, 19 through attachment means 22, 23 are conductive metal bracelets 20 and 21 respectively, which may contain copper for instance, or any other conductive metal suitable to the application of the present invention. The bracelets 20 and 21, or wrist straps, are characterized by their conductive inner core and insulated outer shield which are integral to the cuff sections 18 and 19.

Figure 3:
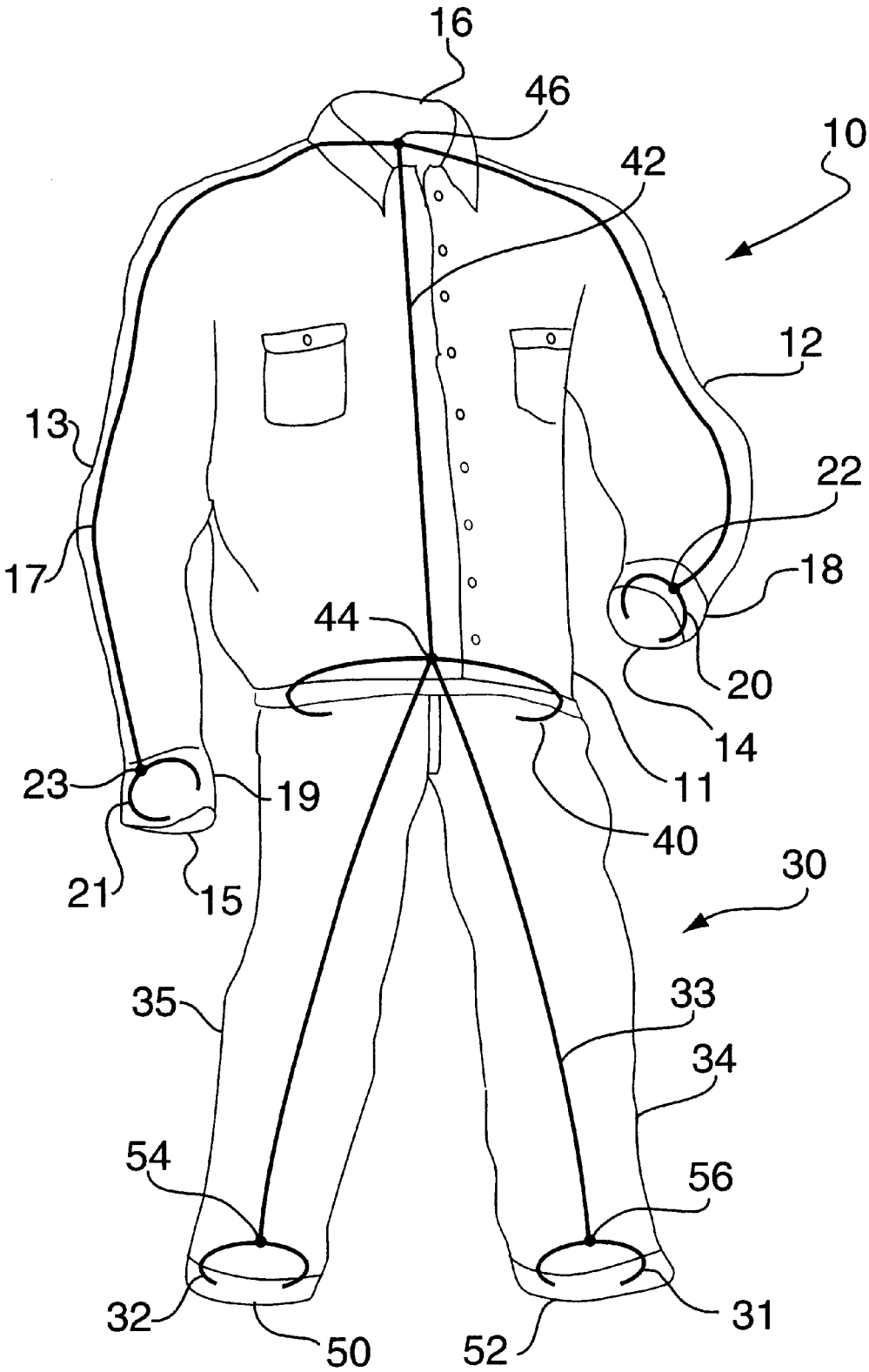
FIG. 3 is a front view of an alternative embodiment of the present invention.

Referring to FIG. 3, in an alternative embodiment, anklets 31 and 32 could be used, in combination with the bracelets 20 and 21 and flexible wire 17. A waistband 40 would be connected to flexible wire 42 using attachment means 44. The flexible wire 42 would be connected to flexible wire 17 at the collar 16 of the garment 10 using attachment means 46. The waistband 40 would be characterized by its conductive inner core and insulated outer shield. The waistband 40 would be connected to flexible wire 33 using attachment means 44 as above described which would then run along the legs 34, 35 of the pants section 30 of the garment. At an ankle section 50 of the pants section 30 the flexible wire 33 would be connected to anklet 32 using attachment means 54. At an ankle section 52 of the pants section 30 the flexible wire 33 would be connected to anklet 31 using attachment means 56. Anklets 31 and 32 would be constructed in a similar manner as bracelets 21 and 22.

It is to be noted that the garment is constructed in a manner that facilitates normal cleaning without impacting its effectiveness in the minimizing of electrocution.

Furthermore, the bracelets 20 and 21 (or anklets 31 and 32 or waistband 40) and flexible wire 17 connection are at such locations as to provide minimal effect on the operations of the worker wearing the garment. The elongate, flexible and washable electrical wire/conductor 17 (or 33 and 42 in the alternative embodiment) provides no interference whatsoever with the worker, either at its exterior or interior portions (of the sleeves or legs) or adjacent the seam.

Figure 2:
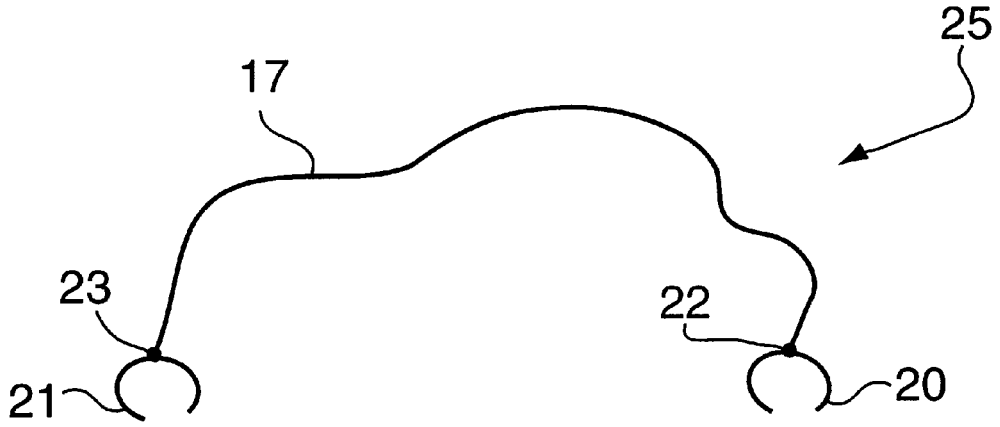
FIG. 2 is a front view of an electricity shunting device of the present invention.
Figure 4:
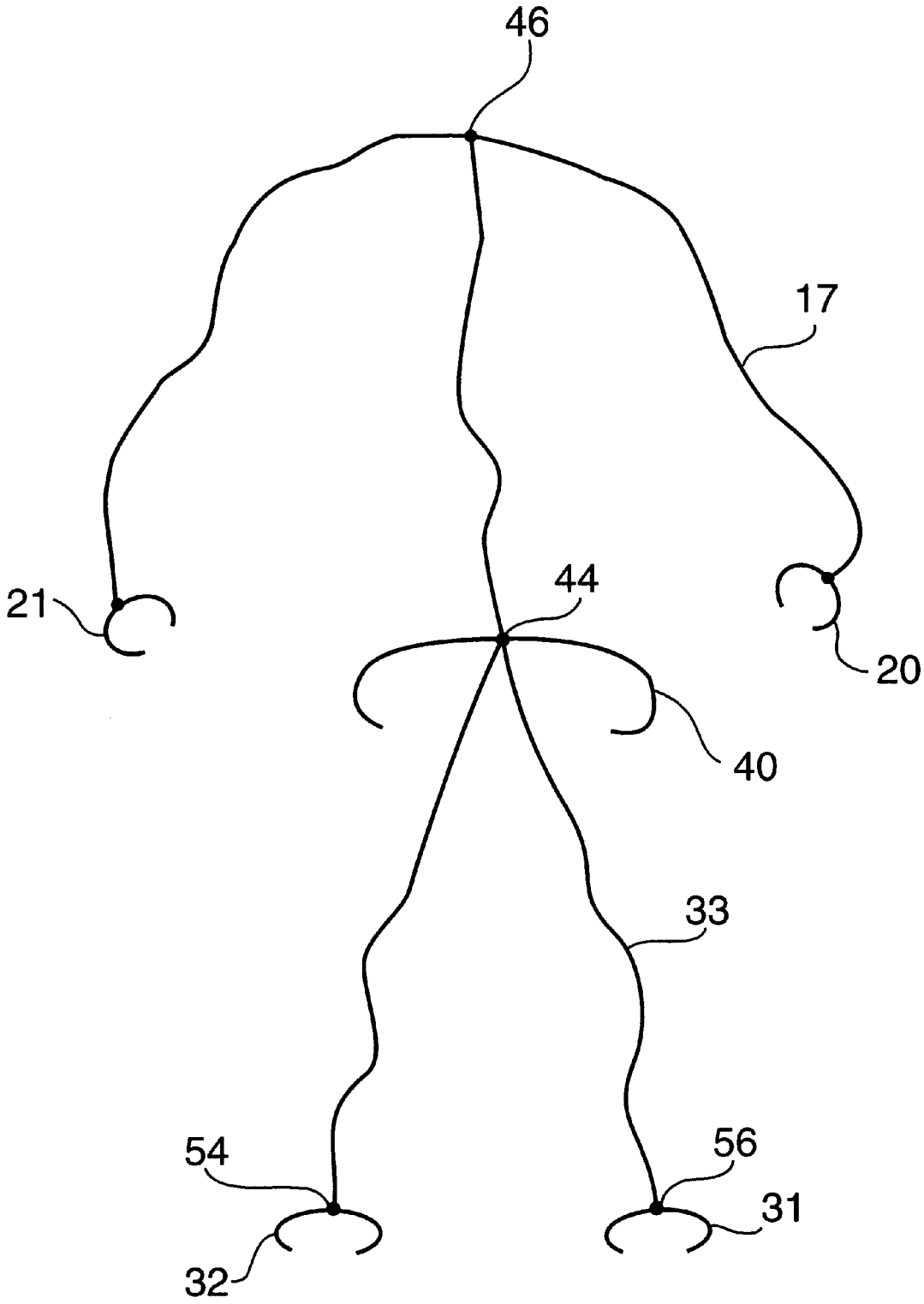
FIG. 4 is a front view of an electricity shunting device of an alternative embodiment of the present invention.

Alternatively, the bracelet/flexible wire combination, as illustrated in FIGS. 2 and 4, can easily be adapted to be temporarily removed from the garment, for washing for instance, or for use of the garment in a non-electrical context through the use of non-permanent attachment means such as hook and loop members (VELCRO™) thereby further preventing any deterioration of the shunting and rerouting device 25 per se.

Figure 5:
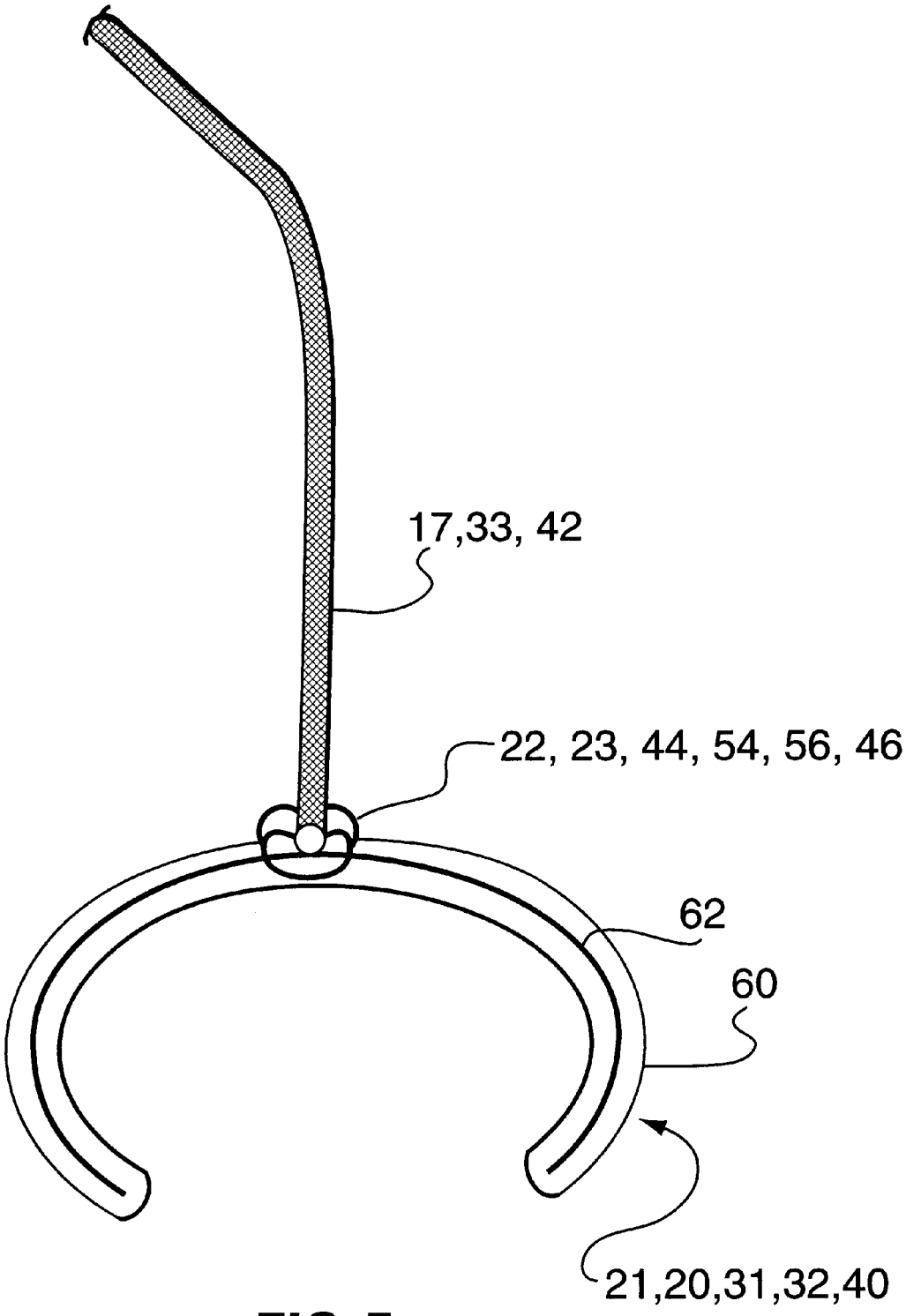
FIG. 5 is a front view of a portion of an electricity shunting device of the present invention.

A portion of the present invention is shown in FIG. 5. Any one of the bracelets 21, 20, 31, 32 or 40 is characterized by their conductive inner core 62 and insulated outer shield 60. The attachment means 22, 23, 44, 54, 56 or 46 is any electrical connection means, such as soldering or welding, as known in the art. The attachment means 22, 23, 44, 54, 56 or 46 contains conductive material, such as copper, which contacts the skin of the wearer. The insulated outer shield, such as a plastic shield, minimizes the likelihood that the present invention comes into direct contact with electrical energy. Rather, electrical energy enters the body of the user, usually through the hand or foot, and then enters the device through the conductive material in the attachment means.

In operation, the described combination garment, bracelet, flexible wire/conductor achieve, when used in combination with approved safety boots in a practical and effective way, the advantages of shunting and rerouting electrical energy away from the worker's heart and muscles in order to reduce or eliminate, depending on the conditions such as various voltage ranges, muscle contractions, diaphragmatic contractions and ventricle fibrillation in the event of contact with live electrical equipment. Safety boots isolate the wearer from the ground thereby preventing an additional path for current to flow.

This shunting and rerouting effect is achieved by allowing the electrical energy to mainly flow through the worker's hands, waist, ankles, the bracelets, the anklets, the waistband and flexible conductors instead of through the heart where an energy surge might be problematic, or even fatal, thereby giving the worker time to detect current and to remove him/herself from a potentially bad if not fatal situation.

An advantage of the present invention is to keep energy away from the heart or other vital organs. A conductor surrounding the heart may shunt electrical energy away from the inner parts of the person, such as the heart or other vital organs. By shunting, the conductor joins two or more points through which current is diverted away from the heart or other like vital organ.

Inner parts protected by the present invention are electrically sensitive organs or muscles, such as, the heart, lungs or diaphragm.

The various embodiments of the invention may be used depending on the level of voltage of the electricity that may enter the body. For example, for extra low voltage two hand bracelets and a waistband may be used. For low voltage, two hand bracelets, and either the waistband or insulated boots may be used. For high voltage, two bracelets, the waistband, two ankle bracelets and boots may be used.

The invention may be embodied in other specific forms without departing from the spirit or essential characteristics thereof. The present embodiments are therefore to be considered as illustrative and not restrictive, the scope of the invention being indicated by the appended claims rather than by the foregoing description, and all changes that come within the meaning and range of equivalency of the claims are therefore intended to be embraced therein.

The embodiment of the invention in which an exclusive property or privilege is claimed are defined as follows:

1. A device for shunting and rerouting electrical current away from vital organs in a body while isolated from ground, comprising:

a flexible conductor;

conductive bracelets adapted to be placed in electrical contact with skin in wrist areas of the body; and attachment means for electrically connecting said flexible conductor to said conductive bracelets.

2. The electrical shunting and rerouting device as defined in claim 1, wherein the flexible conductor is insulated and made of different types of conductive element.

3. The electrical shunting and rerouting device as defined in claim 2, wherein the flexible conductor is made of copper.

4. The electrical shunting and rerouting device as defined in claim 1, wherein the flexible conductor is of sized such that the flexible conductor can conduct a predetermined current.

5. The electrical shunting and rerouting device as defined in claim 1, wherein the conductive bracelets are made of conductive metal.

6. The electrical shunting and rerouting device as defined in claim 5, wherein the conductive metal is copper.

7. The electrical shunting and rerouting device as defined in claim 1, wherein the conductive bracelets comprise a conductive inner core and an insulated outer shield.

8. The electrical shunting and rerouting device as defined in claim 1, wherein the conductive bracelets can be used in combination with anklets and a waistband of same characteristics.

9. A garment for shunting and rerouting electrical current from vital organs in a body while isolated from ground comprising:

a flexible conductor;

conductive bracelets adapted to be placed in electrical contact with skin in wrist areas of the body;

attachment means for electrically connecting said flexible conductor to said conductive bracelets; and means for securing said combination of flexible conductor and conductive bracelets to the garment, said garment having a pair of sleeve sections connected to a body section, said sleeve sections terminating in hems at cuff sections, and a collar section, wherein the flexible conductor is adapted to run uninterrupted along the sleeve and collar sections leading to the conductive bracelets forming part of the cuff sections.

10. The electrical shunting and rerouting garment as defined in claim 9, wherein the flexible conductor is insulated and made of different types of conductive element.

11. The electrical shunting and rerouting garment as defined in claim 10, wherein the flexible conductor is made of copper.

12. The electrical shunting and rerouting garment as defined in claim 9, wherein the flexible conductor is sized such that the flexible conductor can conduct a predetermined current.

13. The electrical shunting and rerouting garment as defined in claim 9, wherein the conductive bracelets are made of conductive metal.

14. The electrical shunting and rerouting garment as defined in claim 13, wherein the conductive metal is copper.

15. The electrical shunting and rerouting garment as defined in claim 9, wherein the conductive bracelets comprise a conductive inner core and an insulated outer shield.

16. The electrical shunting and rerouting garment as defined in claim 9, wherein the garment can be pants whereby the flexible conductor would run along legs down to anklets and the flexible conductor is also connected to a waistband, the waistband and anklets having the same characteristics as the conductive bracelets.

17. The electrical shunting and rerouting garment as defined in claim 16, wherein the garment would be a combination of a shirt and pants.

18. The electrical shunting and rerouting garment as defined in claim 9, wherein the garment is washable.

19. The electrical shunting and rerouting garment as defined in claim 9, wherein the flexible conductor and conductive bracelets combination is adapted to be temporarily removed from said garment through use of non-permanent attachment means.

20. The electrical shunting and rerouting garment as defined in claim 19, wherein said attachment means are hook and loop members.

21. A method for shunting and rerouting electrical energy away from the inner parts of a worker while isolated from ground comprising:

connecting a first flexible conductor to conductive bracelets; and attaching said first flexible conductor and conductive bracelets to a first garment, wherein said first garment worn by said worker will shunt and reroute the electrical energy in order to reduce or eliminate harmful effects of said electrical energy running through said worker's vital organs or muscles.

22. A method as recited in claim 21 further comprising:

wearing said first garment in combination with approved safety boots when coming into contact with live electrical equipment.

23. A method as recited in claim 21 further comprising:

connecting a second flexible conductor to conductive anklets; and attaching said second flexible conductor and conductive anklets to a second garment.

24. A method as recited in claim 21 further comprising:

connecting a second flexible conductor to a conductive waistband; and attaching said second flexible conductor and conductive waistband to a second garment.

25. An electricity shunting and rerouting device comprising:

a flexible conductor;

conductive bracelets having a conductive inner core and an insulated outer shield; and attachment means for connecting said flexible conductor to said conductive bracelets.

26. An electricity shunting and rerouting device comprising:

a flexible conductor;

conductive bracelets; and attachment means for connecting said flexible conductor to said conductive bracelets, wherein the conductive bracelets can be used in combination with anklets and a waistband of same characteristics.

27. The electricity shunting and rerouting device as defined in claim 26, wherein the conductive bracelets, anklets and waistband comprise a conductive inner core and an insulated outer shield.

28. An electricity shunting and rerouting garment comprising:

a flexible conductor;

conductive bracelets having a conductive inner core and an insulated outer shield;

attachment means for connecting said flexible conductor to said conductive bracelets; and means for securing said combination of flexible conductor and conductive bracelets to the garment, said garment having a pair of sleeve sections connected to a body section, said sleeve sections terminating in hems at cuff sections, and a collar section, wherein the flexible conductor is adapted to run uninterrupted along the sleeve and collar sections leading to the conductive bracelets forming part of the cuff sections.

29. The electricity shunting and rerouting garment as defined in claim 28, further comprising:

conductive anklets and a waistband;

attachment means for connecting said flexible conductor to said conductive anklets and waistband; and means for securing said flexible conductor, conductive anklets and waistband to the garment, said garment being a pant garment having a pair of leg sections connected to a body section, wherein the flexible conductor is adapted to run uninterrupted along the leg and body sections leading from the waistband to the conductive bracelets forming part of the cuff sections.

30. An electricity shunting and rerouting garment comprising:

a flexible conductor;

conductive anklets and a waistband;

attachment means for connecting said flexible conductor to said conductive anklets and waistband; and means for securing said combination of flexible conductor and conductive anklets and waistband to the garment, said garment being a pant garment having a pair of leg sections connected to a body section, wherein the flexible conductor is adapted to run uninterrupted along the leg and body sections leading from the waistband to the conductive anklets.

31. An electricity shunting and rerouting garment comprising:

a flexible conductor;

conductive bracelets;

attachment means for connecting said flexible conductor to said conductive bracelets; and hook and loop members for detachably securing said flexible conductor and conductive bracelets to the garment, said garment having a pair of sleeve sections connected to a body section, said pair of sleeve sections terminating in hems at cuff sections, and a collar section, wherein the flexible conductor is adapted to run uninterrupted along the sleeve and collar sections leading to the conductive bracelets forming part of the cuff sections.

32. A method for shunting and rerouting electrical energy away from a worker's inner parts comprising:

connecting a first flexible conductor to conductive bracelets;

attaching said first flexible conductor and conductive bracelets to a garment;

connecting a second flexible conductor to conductive anklets; and attaching said second flexible conductor and conductive anklets combination to the garment, wherein said garment worn by said worker will shunt and reroute the electrical energy in order to reduce or eliminate harmful effects of said energy running through said worker's vital organs or muscles.

33. A method for shunting and rerouting electrical energy away from a worker's inner parts comprising:

connecting a first flexible conductor to conductive bracelets;

attaching said first flexible conductor and conductive bracelets to a garment;

connecting a second flexible conductor to a conductive waistband; and attaching said second flexible conductor and conductive waistband to a garment;

wherein said garment worn by said worker will shunt and reroute the electrical energy in order to reduce or eliminate harmful effects of said energy running through said worker's vital organs or muscles.

* * * * *